US005918592A

United States Patent [19]

Kazubski et al.

[11] Patent Number: 5,918,592

[45] Date of Patent: Jul. 6, 1999

[54] GAS-FIRED LOG BURNER

[75] Inventors: Steven E. Kazubski, Parma; Donald J. Perrin, North Royalton, both of Ohio

[73] Assignee: Gas Research Institute, Chicago, Ill.

[21] Appl. No.: 09/036,008

[22] Filed: Mar. 6, 1998

[51] Int. Cl.[6] ..... F24C 3/00

[52] U.S. Cl. ..... 126/512; 126/92 R; 431/125

[58] Field of Search ..... 126/92 R, 92 AC, 126/512, 500, 503, 92 B; 431/125, 126

[56] References Cited

U.S. PATENT DOCUMENTS

| | | | |
|---|---|---|---|
| 258,922 | 6/1882 | Holland . | |
| 263,255 | 8/1882 | Verity . | |
| 464,457 | 12/1891 | Goetz et al. . | |
| 663,811 | 12/1900 | Dudgeon . | |
| 697,941 | 4/1902 | Hewitt . | |
| 852,679 | 5/1907 | Richards . | |
| 948,561 | 2/1910 | Hansen . | |
| 1,286,108 | 11/1918 | Richards . | |
| 2,084,566 | 6/1937 | Warfield . | |
| 2,762,362 | 9/1956 | Nielsen | 216/92 R |
| 3,113,611 | 12/1963 | Dupler . | |
| 3,181,590 | 5/1965 | Dupler . | |
| 3,993,430 | 11/1976 | Forker . | |
| 4,061,133 | 12/1977 | Swain . | |
| 4,076,490 | 2/1978 | Hilker | 431/125 |
| 4,194,489 | 3/1980 | Swain . | |
| 4,582,478 | 4/1986 | Hilker . | |
| 4,828,485 | 5/1989 | Jankowski . | |
| 5,655,513 | 8/1997 | Whitfield . | |

*Primary Examiner*—James C. Yeung
*Attorney, Agent, or Firm*—Pauley Petersen Kinne & Fejer

[57] ABSTRACT

A gas-fired log burner for simulating natural burning of firewood wherein a gas burner component having a decorative burner face surface engages within a recess formed in an exterior surface of a decorative log component. The recess within the decorative log component receives the gas burner component such that the decorative burner face surface is substantially flush with the exterior surface of the decorative log component.

17 Claims, 2 Drawing Sheets

GAS-FIRED LOG BURNER

BACKGROUND OF THE INVENTION

1. Field of the Invention

This invention relates to a two-piece, gas-fired log burner for simulating natural burning of firewood.

2. Description of the Prior Art

Gas-fired log burners are typically used in connection with indoor fireplaces as a replacement for natural wood burning. Gas-fired log burners provide clean combustion on demand but often do not provide a realistic wood-burning fireplace aesthetic. Many prior-art gas-fired log burners appear artificial both while burning and while not in operation.

Many prior art gas-fired log burners, such as Hilker, U.S. Pat. No. 4,582,478, comprise multiple component configurations with separate gas burners and artificial logs. The artificial logs in such prior art gas-fired log burners are placed on top of or around the gas burners to create the appearance that the artificial logs are burning; to hide the unpleasant appearance of the gas burners; and, to resemble an arrangement of one or more natural logs when the gas burner is not in use. Another advantage of this arrangement is the artificial logs may be replaced when worn out or when a new appearance is desired. However, such separate gas burner and artificial log arrangement often lacks the natural appearance of burning logs because, when the gas burner is in use, the flames from the gas burner do not attach to the surface of artificial logs and instead spread out around the logs.

One prior art solution to the unnatural appearance of the above arrangement is a single-piece, gas-fired log burner comprising one or more ported ceramic logs having one or more burners in a hollowed central portion. Warfield, U.S. Pat. No. 2,084,566, and Richards, U.S. Pat. No. 852,679 teach gas log burners wherein a burner is positioned within a hollow log such that flames pass through ports within the log sidewall. The Richards patent and the Warfield patent each teach an arrangement wherein a burner is positioned within a hollow cavity in a ported log arrangement.

The devices taught by the Richards patent and the Warfield patent rely upon the configuration of the cavity and ports within the log arrangement to generate a realistic effect. When the burner is started, the flames are forced through various ports throughout the log arrangement thus creating the appearance that the flames are attached to the log surface. When the burner is not in use, such a log arrangement often appears unrealistic because the ports are visible along the log surface. Also, because of the typically permanent interface between the gas burner and the log arrangement, the entire gas-fired log burner must be replaced if either the burner or the log arrangement requires replacement.

Whitfield, U.S. Pat. No. 5,655,513, teaches an artificial log burner wherein a slotted artificial log contains a gas supply conduit having corresponding slots. As taught in the Richards patent and the Warfield patent, the Whitfield patent teaches an artificial log having a central cavity that receives both a burner and a gas supply. Also, as in the Richards patent and the Warfield patent, the artificial log burner does not appear realistic when not in use because of the visible slots in the log surfaces. Further, because of the close relationship between the arrangement of slots in the artificial log and the gas supply conduit, the entire artificial log burner must be replaced if either the artificial log or the gas supply conduit requires replacement.

Therefore, a replaceable component gas-fired log burner is desirable that does not appear artificial when not in operation and does not have flames dancing between and around logs when in operation. A gas-fired log burner is desirable that provides the illusion that flames are attached to a log that appears consumed with fire and that resembles natural wood when not in operation.

SUMMARY OF THE INVENTION

It is one object of this invention to provide a gas-fired artificial log burner that creates the natural appearance of burning firewood.

It is another object of this invention to provide a gas-fired artificial log burner that allows a decorative log component to be replaced with another decorative log component without replacement of a gas burner.

It is another object of this invention to provide a gas-fired artificial log burner that permits a decorative log component to display an opposite longitudinally disposed side having the same or different appearance for viewing from an adjacent room in a two-way fireplace or to allow for rotation of the decorative log component to create a new appearance.

It is a further object of this invention to provide a gas-fired artificial log burner that has a realistic appearance whether or not the log burner is in operation.

It is yet another object of this invention to provide a gas-fired artificial log burner wherein the flames from the gas burner appear to attach to the surface of the decorative log during operation.

A gas-fired log burner according to a preferred embodiment of this invention comprises a gas burner component and a decorative log component engaged to create the appearance of a single log.

The gas burner component comprises a burner face surface, a burner housing and a gas inlet. Gas is introduced to the gas inlet, ignited in the burner housing and exits through the burner face surface. The burner face surface is preferably covered with a natural appearing decorative material, such as ceramic.

The burner face surface preferably contains a plurality of ports positioned and sized to provide a realistic burning effect on the burner face surface when the gas-fired log burner is burning and when the gas-fired log burner is not in operation. Preferably, the decorative material positioned on the burner face surface forms grooves within which the ports are preferably formed.

The decorative log component, like the burner face surface is manufactured with a natural external appearance, preferably a ceramic material. Preferably, the burner face surface is substantially similar in appearance to an exterior surface of the decorative log component.

The decorative log component contains a recess formed in the exterior surface of the decorative log component. The recess accommodates the gas burner component whereby the burner face surface is substantially flush with the exterior surface of the decorative log component.

In another preferred embodiment of this invention, the decorative log component and/or the gas burner component comprise longitudinally disposed opposite sides, each opposite side having a different decorative appearance. Such an arrangement allows the gas-fired log burner to be viewed from longitudinally disposed opposite sides, such as in an open gas fireplace arrangement or from two different rooms facing a two-sided gas fireplace.

BRIEF DESCRIPTION OF THE DRAWINGS

The above-mentioned and other features and objects of this invention will be better understood from the following detailed description taken in conjunction with the drawings wherein.

DESCRIPTION OF THE PREFERRED EMBODIMENTS

Figure 1:
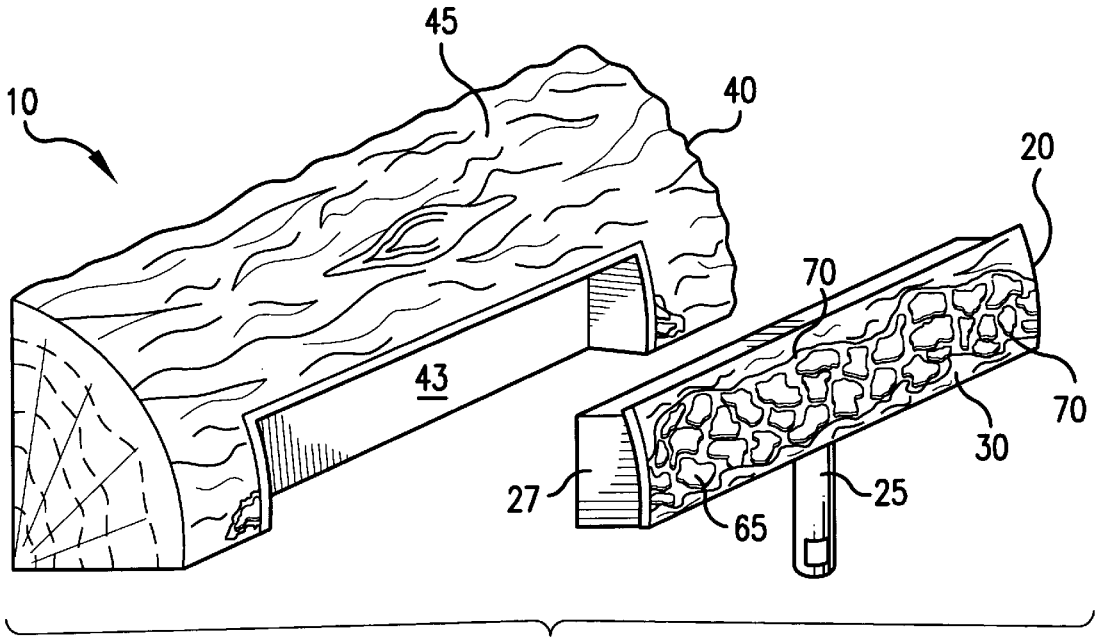
FIG. 1 is a perspective view of a gas-fired log burner in a disassembled state according to one preferred embodiment of this invention.
Figure 2:
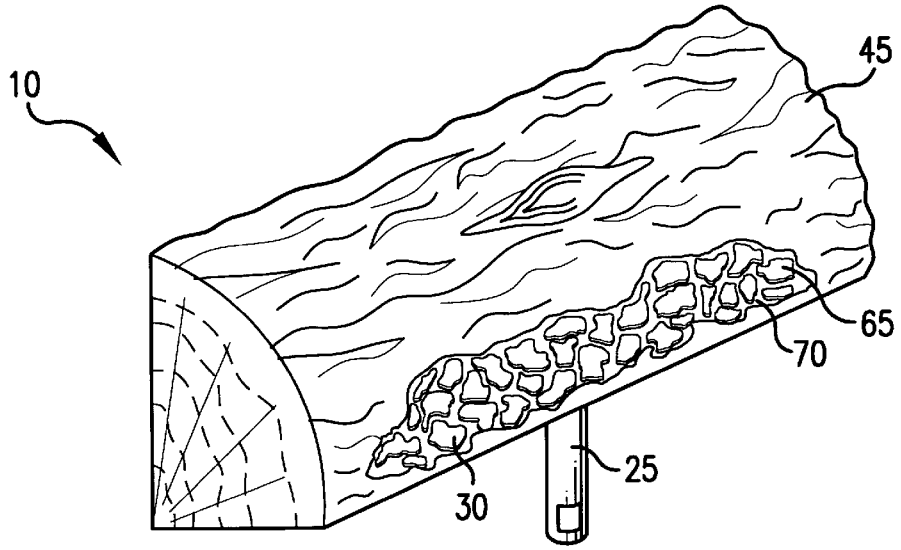
FIG. 2 is a perspective view of an assembled version of the gas-fired log burner shown in FIG. 1.

FIG. 1 shows gas-fired log burner 10 in a disassembled state according to one preferred embodiment of this invention. Gas-fired log burner 10 according to a preferred embodiment of this invention comprises gas burner component 20 and decorative log component 40. FIG. 2 shows gas-fired log burner 10 in an assembled state wherein gas burner component 20 is connected with respect to decorative log component 40, so that gas-fired log burner 10 appears to comprise a single log.

According to one preferred embodiment of this invention, gas burner component 20 comprises burner face surface 30, burner housing 27 and gas inlet 25. Gas inlet 25 is preferably rigidly connected to a gas outlet in the fireplace. Gas, such as natural gas or propane, is introduced to gas inlet 25 through a valve or other regulation means by which gas flow is controlled. Burner housing 27 is preferably constructed from a heat resistant material, such as sheet metal, that is easily workable into a variety of configurations. Burner housing 27 preferably accomodates burner face surface 30.

Burner face surface 30 is preferably covered by decorative material 65. As used throughout this specification, burner face surface 30 includes either decorative material 65 added on to burner face surface 30 or an integral decorative element. Decorative material 65 is preferably cemented on to burner face surface 30 with an adhesive having heat-resistant properties. Alternatively, burner face surface 30 may comprise an integral decorative element consisting entirely of a plaque of decorative material 65 positioned with respect to burner housing 27. In one preferred embodiment of this invention, shown in the figures, decorative material 65 is configured to resemble a charred wood surface. Decorative material 65 may be cordierite, other ceramic material, or any other refractory material known to those having ordinary skill in the art. Preferably, decorative material 65 has refractory properties and is millable to create a natural wood, charred wood, tree bark or cracked grained split wood appearance. Decorative material 65 preferably has a thickness of approximately 0.333 inches to 0.500 inches.

Figure 3A:
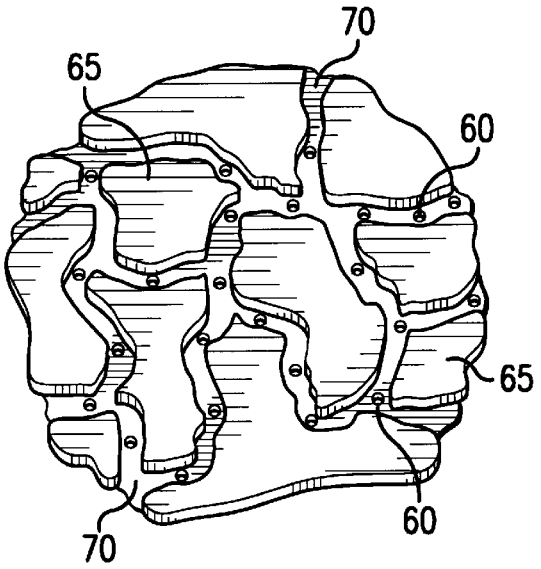
FIG. 3 is a perspective view of a gas burner component showing a magnified view of a burner face surface according to one preferred embodiment of the invention.
Figure 3:
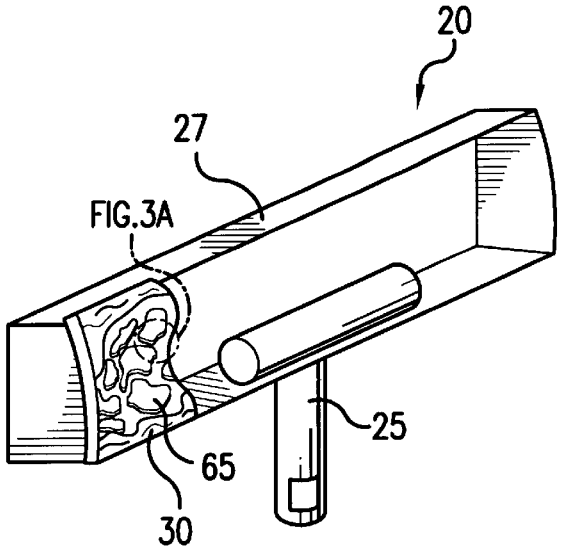

As best shown in FIG. 3, burner face surface 30 preferably contains a plurality of ports 60. Ports 60 are positioned and sized to provide a realistic burning effect on burner face surface 30 when gas-fired log burner 10 is in operation. In one preferred embodiment of this invention, ports 60 are approximately 0.052 inches in diameter with a total ported area length of 8⅙ inches containing 98 ports and a total ported area height of 1½ inches. Ports 60 are preferably arranged at an approximate density of 8 ports per square inch.

The second primary component of gas-fired log burner 10 is decorative log component 40. Decorative log component 40, like burner face surface 35 is manufactured with the external appearance of firewood. Decorative log component 40 is preferably made from a refractory or ceramic fiber material in the shape of a whole or split piece of firewood. Preferably, burner face surface 30 is substantially similar in appearance to exterior surface 45 of decorative log component 40. Alternatively, burner face surface 30 is substantially complimentary in appearance to exterior surface 45 of decorative log component 40 such that burner face surface 30 blends in with portions of exterior surface 45.

Figure 4:
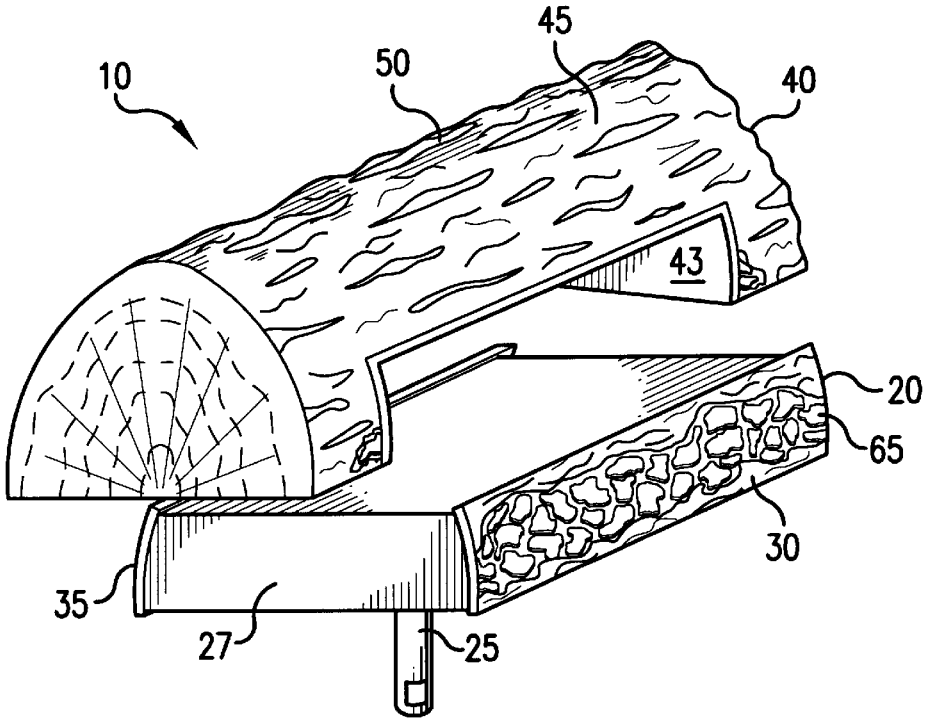
FIG. 4 is a perspective view of a gas-fired log burner in a disassembled state according to another preferred embodiment of this invention.

Preferably decorative log component 40 is substantially cylindrical or a cylinder segment. As shown in FIGS. 1 and 2 decorative log component may comprise a cylinder segment having an arc of approximately 90° or, in one alternative, 180° as shown in FIG. 4. Accordingly, any other configuration of decorative log component 40 that resembles natural wood and may be configured as described herein may also be appropriate.

Decorative log component 40 contains recess 43 formed in exterior surface 45 of decorative log component 40. Recess 43 receives gas burner component 20 whereby burner face surface 30 is substantially flush with exterior surface 45 of decorative log component 40. As used throughout the specification and the claims, substantially flush is defined as a continuity of surface appearance between burner face surface 30 and exterior surface 45. According to one preferred embodiment of this invention, burner housing 27 mates within recess 43 so that only burner face surface 30 of gas burner component 20 is exposed to view. Burner face surface 30 is thereby preferably exposed to view in either its entirety or at multiple places along a length of the gas-fired log burner 10.

Recess 43 may be positioned in decorative log component 40 at any position around the circumference of decorative log component 40. In one preferred embodiment of this invention, shown in the drawings, recess 43 is positioned in a bottom portion of decorative log component 40. This position of recess 43 facilitates replacement or rotation of decorative log component 40 and also conceals gas inlet 25 under decorative log component 40.

In one preferred embodiment of this invention, shown in FIG. 3, at least one piece of decorative material 65 positioned on burner face surface 30 forms at least one groove 70. Groove 70 may be formed between adjacent pieces of decorative material 65 or formed throughout a single slab of decorative material 65 on burner face surface 30. Grooves 70 help create a realistic appearance of charred wood or bark on burner face surface 30. In one preferred embodiment of this invention, grooves 70 range between 0.075 inches and 0.200 inches deep and between 0.058 inches and 0.150 inches wide.

In one preferred embodiment of this invention, shown in FIG. 3, the plurality of ports 60 are positioned within grooves 70 on burner face surface 30. Such an arrangement hides ports 60 within grooves 70 and, when gas-fired log burner 10 is in operation, creates the appearance that the flames are anchored to decorative material 65 on burner face surface 30. In one preferred embodiment of this invention, grooves 70 do not extend all the way through decorative material 65 to burner face surface 30. In such an embodiment, ports 60 are machined into decorative material 65 and correspondingly into burner face surface 30.

In another preferred embodiment of this invention, as shown in FIG. 4, decorative log component 40 comprises longitudinally disposed opposite sides, first exterior surface 45 having an exterior appearance such as bark, charred wood or cracked wood and a second exterior surface 50, opposite first exterior surface 45, having a different decorative appearance from the decorative appearance of first exterior surface 45. This arrangement allows gas-fired log burner 10 to be viewed from longitudinally disposed opposite sides, such as in an open gas fireplace arrangement or from two different rooms facing a two-sided gas fireplace. This arrangement also permits the rotation of decorative log component 40 so that separate appearances can be created by a single gas-fired log burner 10 when a new appearance is desired or when first exterior surface 45 is worn out.

As described above, the surface appearance of burner face surface 30 is preferably indistinguishable from the surface appearance of decorative log component 40 resulting in the appearance of a single burning log. In one preferred embodiment of this invention burner face surface 30 is curved to match a curvature of exterior surface 45 of decorative log component 40. Such a curvature enables burner face surface 30 to blend in more effectively with decorative log component 40 and better disguise the outer edges of burner face surface 30. Decorative log component 40 may, however, resemble split wood thus requiring a planar burner face surface 30 to blend in with a planar exterior surface 45 of decorative log component 40.

In another preferred embodiment of this invention, also shown in FIG. 4, gas burner component 20 comprises additional burner face surface 35 on second side of gas burner component 20 opposite burner face surface 30. This configuration of gas burner component 20 is also beneficial for an open gas fireplace arrangement or with a two-sided gas fireplace. Preferably, gas burner component 20 according to this embodiment of the invention is used with decorative log component 40 having first exterior surface 45 and second exterior surface 50 as described above.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

We claim:

1. A gas-fired log burner for simulating natural burning of firewood comprising:

a gas burner component having a decorative burner face surface; and a decorative log component having a recess formed in an exterior surface of the decorative log component, the recess receiving the gas burner component whereby the decorative burner face surface is substantially flush with the exterior surface.

2. The burner of claim 1 wherein the decorative burner face surface forms a plurality of ports.

3. The burner of claim 2 wherein at least one piece of a decorative material comprising the decorative burner face surface forms at least one groove, the plurality of ports being disposed within the at least one groove.

4. The burner of claim 3 wherein the decorative material is a ceramic material.

5. The burner of claim 1 wherein the decorative log component comprises longitudinally disposed opposite sides, each of the opposite sides having a different decorative appearance.

6. The burner of claim 1 wherein the decorative burner face surface is substantially similar in appearance to the exterior surface of the decorative log component.

7. The burner of claim 1 wherein the decorative burner face surface is substantially complimentary in appearance to the exterior surface of the decorative log component.

8. The burner of claim 1 wherein the decorative burner face surface is curved to match a curvature of the exterior surface of the decorative log component.

9. The burner of claim 1 wherein the gas burner component comprises an additional decorative burner face surface on a side of the gas burner component opposite the decorative burner face surface.

10. The burner of claim 1 wherein the decorative log component is substantially cylindrical.

11. The burner of claim 10 wherein the recess is formable in the decorative log component at any position around the circumference of the decorative log component.

12. The burner of claim 1 wherein the decorative log component is a cylinder segment having an arc less than 270°.

13. The burner of claim 1 wherein the decorative log component is a cylinder segment having an arc less than 180°.

14. The burner of claim 10 wherein the decorative log component is a cylinder segment having an arc less than 90°.

15. A gas-fired log burner for simulating natural burning of firewood comprising:

a gas burner component having a decorative burner face surface and forming a plurality of ports;

a decorative material provided on the burner face surface, the decorative material forming at least one groove, the plurality of ports being disposed within the at least one groove; and a decorative log component having a recess formed in an exterior surface of the decorative log component, the recess receiving the gas burner component whereby the decorative burner face surface is substantially flush with the exterior surface.

16. The burner of claim 15 wherein the decorative log component comprises longitudinally disposed opposite sides, each of the opposite sides having a different decorative appearance.

17. A method for simulating natural burning of firewood using a gas-fired log burner comprising:

introducing a gas flow to a gas burner component of the gas-fired log burner having a decorative burner face surface whereby the gas burner component engages a decorative log component of the gas-fired log burner having a recess formed in an exterior surface of the decorative log component so that the decorative burner face surface is substantially flush with the exterior surface.

* * * * *